United States Patent [19]

Kempf et al.

[11] 4,276,739

[45] Jul. 7, 1981

[54] ELECTRONICALLY CONTROLLED SYSTEM FOR MAKING A MULTIPLY EFFECT YARN

[75] Inventors: Gerhard Kempf; Albert Kunz, both of Arbon, Switzerland

[73] Assignee: Evolution SA, Rorschach, Switzerland

[21] Appl. No.: 94,062

[22] Filed: Nov. 14, 1979

[30] Foreign Application Priority Data

Nov. 15, 1978 [DE] Fed. Rep. of Germany ..... 2849567

[51] Int. Cl.[3] ..... D01H 1/30; D01H 1/22; D01H 1/26

[52] U.S. Cl. ..... 57/91; 57/92; 57/93

[58] Field of Search ..... 57/209, 206, 90, 91, 57/92-94, 100

[56] References Cited

U.S. PATENT DOCUMENTS

| | | | |
|---|---|---|---|
| 3,393,503 | 7/1968 | Lucas | 57/94 |
| 3,407,589 | 10/1968 | Hasegawa | 57/91 |
| 3,445,999 | 5/1969 | DeRuig | 57/94 |
| 3,449,899 | 6/1969 | Cureton et al. | 57/91 X |
| 4,100,399 | 7/1978 | Bager | 57/91 X |
| 4,161,862 | 7/1979 | Hartmannsgruber et al. | 57/92 |

*Primary Examiner*—Donald Watkins
*Attorney, Agent, or Firm*—Karl F. Ross

[57] ABSTRACT

A multiply effect yarn is wound up from a plurality of strands on a yarn-winding body that is rotated at a variable predetermined speed. Each of the strands is fed via a respective strand-feed element to the yarn-winding body. The feed rate of each of these strand-feed elements can be individually varied, and is established as a function of the rotation rate of the yarn-winding body to maintain a predetermined proportionality between the various speeds. The drive for each strand-feed element comprises a separate pair of variable-speed motors set to operate at different speeds and operated by forward and backward counters so that either the one motor or the other motor of each drive is connected to the respective feed element which can also be connected to a brake, if desired. The various speed rates can rapidly be adjusted, in accordance with the overall drive rate for the yarn-winding body, even during production of the multiply effect yarn.

14 Claims, 4 Drawing Figures

$51_{1a}$
INVER-TER
$54_{1a}$
$K_{1a}$
$54_{1b}$
$B_1$
$61_1$
$58_1$
INVER-TER
$K_1$
$54_1$
50
DIVIDER
51
FORWARD COUNTER
$60_{1a}$
$60_1$
52
$T_{1a}$
$T_1$
DIVIDER
BACKWARD COUNTER
55
56
53

$17_{3a}$
70
$23_{3a}$
6
DETECTOR
M
MOTOR
71
5
19
2

ELECTRONICALLY CONTROLLED SYSTEM FOR MAKING A MULTIPLY EFFECT YARN

FIELD OF THE INVENTION

The present invention relates to a system for making a multi-ply effect yarn. More particularly this invention concerns such a system which combines a plurality of separate strands that are twisted together to form a so-called effect or multi-ply yarn.

BACKGROUND OF THE INVENTION

A multi-ply yarn such as a novelty yarn, a double yarn, a flame yarn, a boucle yarn, a knob yarn or the like is made by winding together several strands, with the individual strands being fed to the winding-together location at different speeds. Frequently the strands are different types of yarns.

The standard apparatus for making such a multi-ply yarn has a plurality of strand-feed elements that can each be driven by a respective drive. Normally each such drive must be capable of operating at two separate speeds, and must be capable of stopping when desired. Thus the drives normally comprise complicated transmissions capable of driving the strand-feed elements at the desired speeds.

An enormous disadvantage of this system is that it is an extremely complex matter to set up so as to produce a given effect. The transmissions are normally dismantled, with gears being switched, and other changes to the mechanism must be made each time a new novelty yarn is to be produced. What is more each such setting-up requires that the machine be brought to a complete standstill and virtually be rebuilt. Obviously the expense and bother of such an arrangement is enormously disadvantageous.

OBJECTS OF THE INVENTION

It is therefore an object of the present invention to provide an improved system for making an effect yarn.

Another object is to provide such a system which can be set up relatively easily to produce any of various types of effect yarn and which can even be readjusted while operating to change a particular aspect of the yarn being produced.

SUMMARY OF THE INVENTION

These objects are attained according to the instant invention in a system wherein each of the drives for each of the strands comprises a pair of variable-speed motors. The control means allows the speeds of these motors to be set purely electronically to achieve the desired motor speeds. Thus the operator of such a machine by simply setting a dial can obtain a given output speed for a given motor.

According to further features of this invention each of the motors is connected to the respective yarn-feed element, normally a yarn-advance drum, through a respective clutch, and each strand-feed element is further provided with a brake. Thus if one clutch is open and the other closed the element will be driven at one speed, if the other is open and the one is closed the element will be driven at another speed and if both are open and the brake is actuated the yarn-feed element will stop.

The operation of the various clutches and brakes is effected by means of a simple electronic system using a data carrier most simply constituted as an endless loop of perforated tape having a track for each motor. The tape is read step-wise, and each step corresponds to a predetermined angular displacement of the yarn-winding body. The tape is first read forward through a number of presettable steps, then is automatically reversed and read backward through the same or a different number of steps, then the cycle is repeated. It is possible by stepping forwardly and backwardly through different distances to vary the pattern within certain limits, without, however, the use of a random generator. It is merely necessary that the closed loop of tape have an overall length which can be evenly divided by the repeat of all of the various patterns.

According to this invention the motors are of the electronically or electrically controllable type. Preferably they are induction motors whose output speeds are directly related to the frequency of their output voltages. In this manner it is possible to generate a simple analog voltage having a magnitude proportional to the desired motor speed, and to pass this voltage through a voltage/frequency converter to the motor. A similar such arrangement may drive the yarn-winding body. It is also possible according to this invention to generate a series of pulses having a frequency proportional to the rotation rate of the yarn-winding body, to convert this into an analog voltage, and to multiply this analog voltage by the analog reference-signal voltage for the particular strand-feed motor. In this manner as the takeup speed is increased the feed speed for all of the strands will be proportionately increased, so that the same proportion or pattern will be maintained in the produced yarn even though it is made at a faster or slower rate.

According to this invention another pulse generator is provided on the output of each of the strand-feed motors, and is connectable to a multiplier and to a display which can show the operator of the device exactly what the particular strand-advance speed is. Thus it is possible in a very simple manner for the operator to set the machine up. The rotation rate of the yarn-winding body can similarly be displayed.

The pulse train whose frequency is proportional to the rotation rate of the yarn-winding body can be reduced to an analog voltage and compared in a comparator with a reference voltage that is established by the operator of the machine. A comparator generates an error signal which is used to drive the yarn-winding motor to operate same at the desired speed.

It is normally desired to make the yarn-winding body rotate as rapidly as possible, so that once the machine is set up it will be normal for the operator to increase the rotation rate for the yarn-winding body to the maximum level. Such a procedure could, however, result in exceeding a maximum speed for any of the strand-feed motors. Thus according to this invention when any of the strand-advance motors rotates at a speed greater than the predetermined maximum, the yarn-winding body is arrested, or at least is prevented from rotating more rapidly. This can be done simply by passing all of the analog reference-value signals for the strand-feed motors through an OR gate to a threshold circuit which blocks further increases in the voltage from the reference-value generator for the yarn-winding body when any of the feed motor reference-value signals exceeds a predetermined threshold.

In a system as described above, using a closed loop of tape serving as the data carrier for operating the various clutches and brakes, it is possible to step this data carrier or read it stepwise at a rate which is dependent on the rotation rate of the yarn-winding body. Unlike a system such as described in German Pat. No. 2,539,341, such an arrangement easily allows the pattern or effect to be compressed or expanded on the yarn. It is merely necessary to change the proportion between the advance or read rate of the data carrier and the rotation rate of the yarn-winding body.

Such a system, with the above-described backward and forward reading of the data carrier, allows a yarn to be produced without a discernable pattern, but nonetheless with the desired effect. In addition it is possible for a plurality of such machines to produce absolutely identical apparently pattern-free yarns, something which was completely impossible in an arrangement using a random generator. It is also possible to use some of the information track on the data carrier to hold repeat data or the like so that the particular sections of the data carrier can be run through several times to repeat particular effects, with the direction change in the reading of the data carrier being controlled itself by direction instructions directly on the data carrier.

It is possible with this system to provide inverters between the outputs of the reader and the clutches, so that if a given clutch is to remain closed most of the time, for instance, it can be made to respond to a lack of information, that is to a clear unpunched track, rather than a series of holes. Such an arrangement makes the data carrier much easier to load with information.

It is also possible according to this invention to provide an alternating-current generator connected to the voltage input of the voltage/frequency converter of one of the motors. Such an alternating-current generator with an automatically and, if desired, sinusoidally increasing and decreasing rotation rate allows the respective motor to produce yet another patterning effect.

SPECIFIC DESCRIPTION

Figure 1:
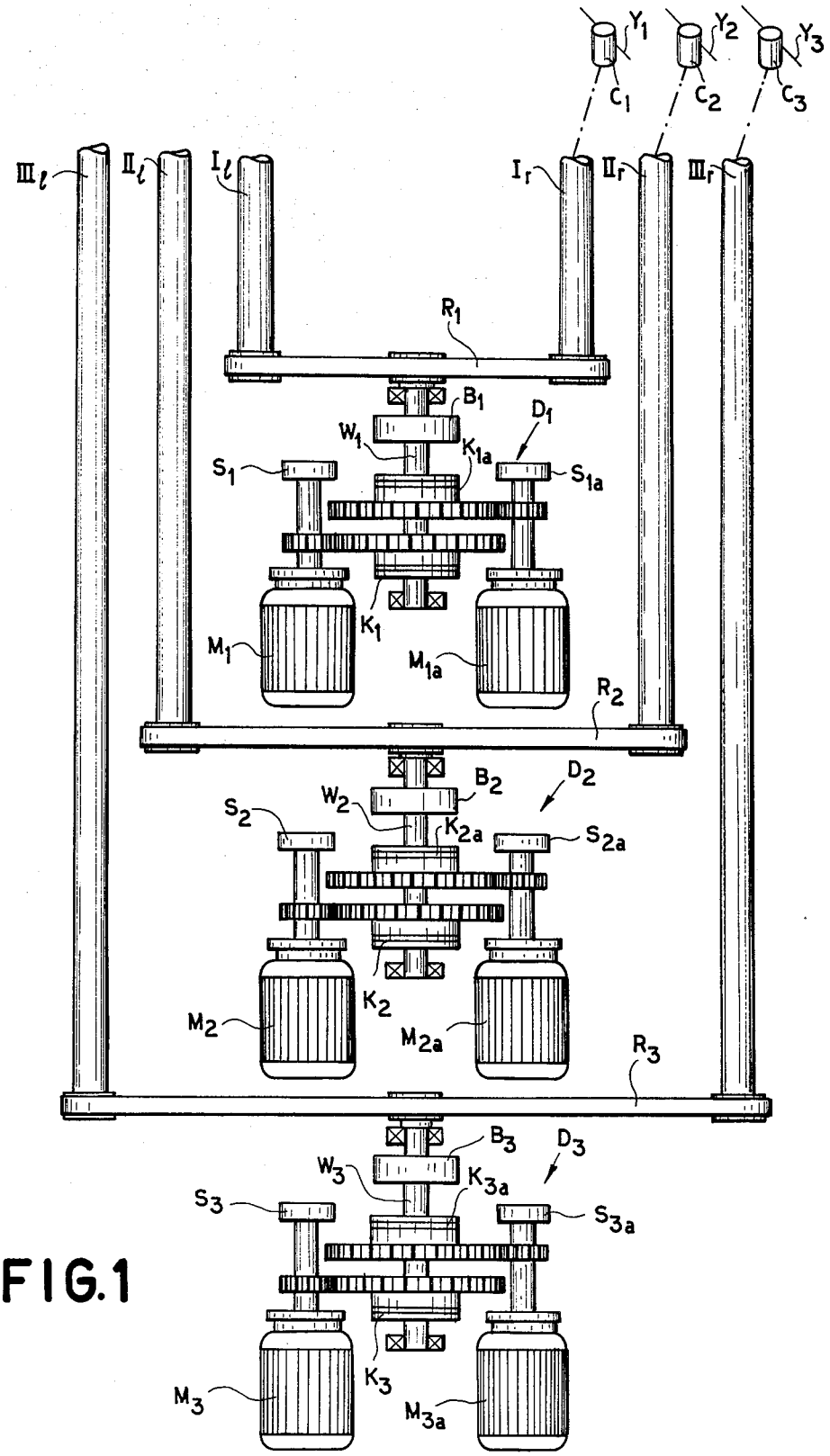
FIG. 1 is a side perspective view illustrating the strand drive according to this invention.

As seen in FIG. 1 the system according to this invention basically comprises three strand feeders or drives $D_1$, $D_2$, and $D_3$. Each of these drives has a main shaft $W_1$, $W_2$, and $W_3$ that drives a respective belt $R_1$, $R_2$, and $R_3$ that in turn drives a respective pair of output shafts $I_r$, $I_1$, $II_r$, $II_1$; and $III_r$, $III_1$ that drive respective strand-advance rollers of which three are shown at $C_1$, $C_2$, and $C_3$. The system is set up so that each of the drives $D_1$, $D_2$, and $D_3$ serves a pair of yarn-winding bobbins.

The drives $D_1$, $D_2$, and $D_3$ each comprise a respective pair of induction-type variable speed electric motor $M_1$, $M_{1a}$; $M_2$, $M_{2a}$; and $M_3$, $M_{3a}$. These motors $M_1$–$M_{3a}$ have output shafts carrying respective flywheels $S_1$–$S_{3a}$ and connected via respective electrical clutches $K_1$–$K_{3a}$ to the respective shafts $W_1$–$W_3$. In addition these shafts $W_1$, $W_2$, and $W_3$ can be arrested by means of respective brakes $B_1$, $B_2$, and $B_3$. Normally the motors of each drive are set to operate at different speeds, so that each of the strands or yarns shown schematically in FIG. 1 at $Y_1$, $Y_2$, and $Y_3$ can be fed at either of two speeds, or arrested completely.

Figure 2:
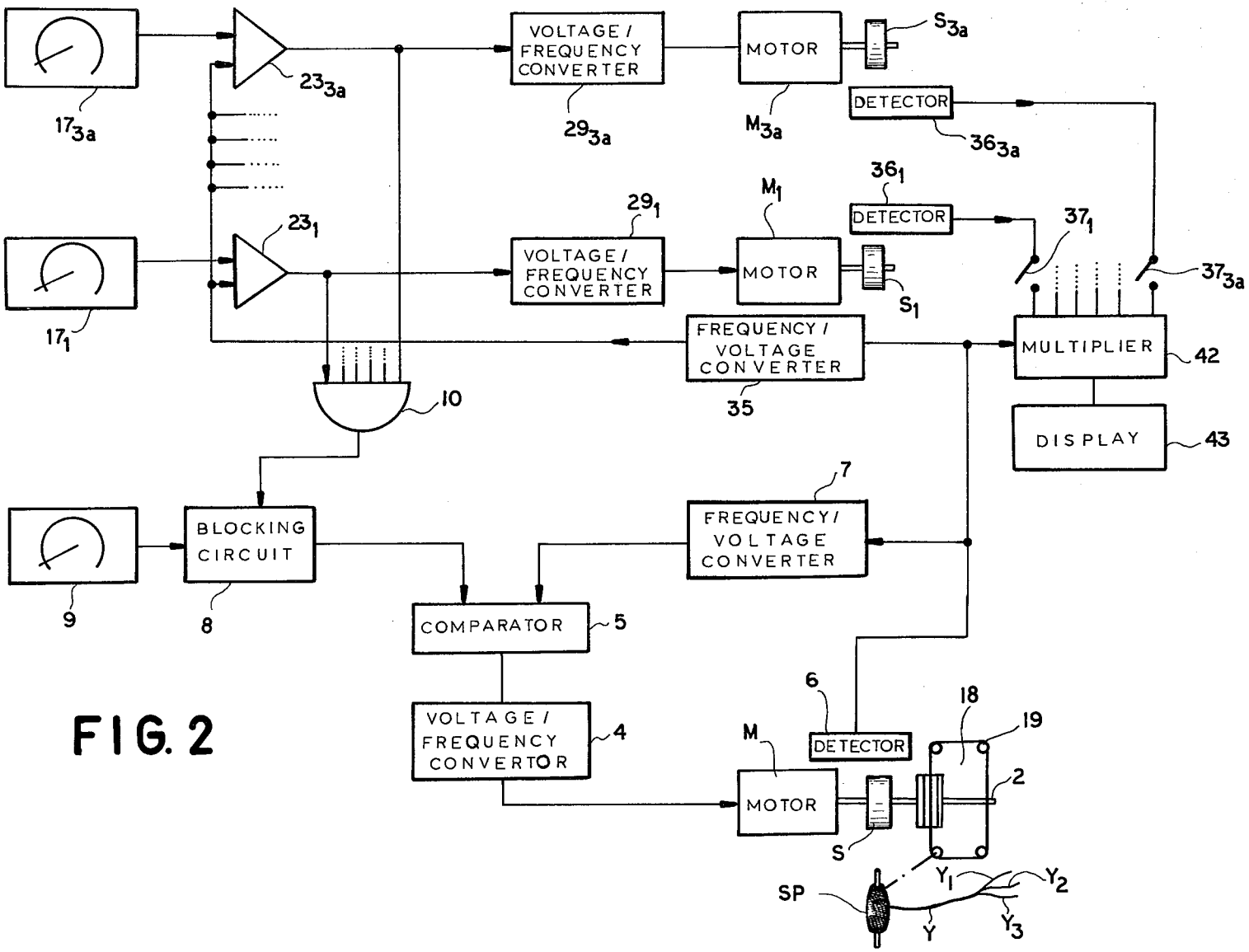
FIG. 2 is a partially schematic and diagrammatic view illustrating the system according to this invention and in particular showing the control arrangement.

FIG. 2 shows how the motors $M_1$ and $M_{3a}$, which are of the type whose output speed is directly related to the frequency of its alternating-current feed voltage, is driven by a respective voltage/frequency converter $29_1$ and $29_{3a}$, driven in turn by an operational amplifier $23_1$ and $23_{3a}$ in turn connected to a variable-voltage input device $17_1$ and $17_{3a}$ which is set by the operator of the machine. The motors $M_{1a}$, $M_2$, $M_{2a}$ and $M_3$ are connected to identical circuitry. In addition the flywheels $S_1$ and $S_{3a}$ of the motors $M_1$ and $M_{3a}$ are associated with respective speed detectors $36_1$ and $36_{3a}$ which generate output pulses of a frequency exactly equal to the actual angular rotation speed of the respective output shaft. These signals can be sent through respective switches $37_1$ and $37_{3a}$ to a multiplier or calculator 42 connected in turn to a display 43.

In addition a main drive motor M has an output shaft carrying a main flywheel S and connected to a drive roller that operates a belt 18 that in turn operates a spindles 19 to each of which a yarn Y formed of the three yarns $Y_1$, $Y_2$, and $Y_3$ is fed. This motor is also of the induction variable-speed type. A detector 6 associated with the flywheel S also feeds a signal to the multiplier 42 so that by closing, for instance, of the switch $37_1$ the feed rate in meters per minute for the yarn $Y_1$ when driven by the motor $M_1$ can be calculated and seen on the display 43.

In addition an input device 9 for generating a reference value for the speed of the motor M is connected via a blocking circuit 8 whose function will be described below to one input of a comparator 5 whose other input is connected via a frequency/voltage converter 7 to the pulse generator or speed detector 6. The error signal constituted by the output of the comparator 5 is fed to a voltage-frequency converter 4 and back to the motor M. Thus a desired speed set on the input device 9 will be compared with the actual speed of the flywheel S and the error signal generated by the comparator 5 will be used to correct the speed of the motor M.

The output of the speed detector 6 is further connected via a frequency/voltage converter 35 to the various operational amplifiers $23_1$ and $23_{1a}$ which act also as multipliers. In this manner the speed of the motors $M_1$ and $M_{3a}$ will be controlled not only in accordance with the reference values generated by the respective input devices $17_1$ and $17_{3a}$, but also in accordance with the rotation rate of the spindle SP. Such an arrangement allows the rotation rate for the spindle SP to be established and adjusted independently of the output speeds for the motors $M_1$–$M_{3a}$. Instead every one of the analog signals generated by the input devices $17_1$ and $17_{3a}$ will be combined with the analog actual-value signal coming from the converter 35 to assure exact proportionality between the various rotation rates.

In order to prevent the operator of the machine from accidentally setting one of the speeds of one of the motors $M_1$–$M_{3a}$ too high, the outputs of the operational amplifiers or multipliers $23_1$ and $23_{3a}$ are connected to an OR gate 10 and thence to the blocking circuit 8 which acts as a threshold device. In the event that a signal is fed to the blocking circuit 8 that is above a Predetermined limit this circuit 8 will cut off the input device 9 to prevent the motor M from going any faster.

Obviously at the same time a signal will be set off to indicate to the operator that an impossible setting has been made. It is therefore possible for an operator to set up the machine by setting the dials on the various input devices without having to refer to a guide manual or the like. In the event that an impossible setting is made the machine simply will not comply, so that the operator need merely, normally, reduce the overall rate established by the motor M to make the machine operational. It is also possible to adjust any of the motor speeds while the machine is operating, and the feed speed can be displayed on the device 43 simply by closing the appropriate switch connected to the appropriate speed detector.

Figure 3:
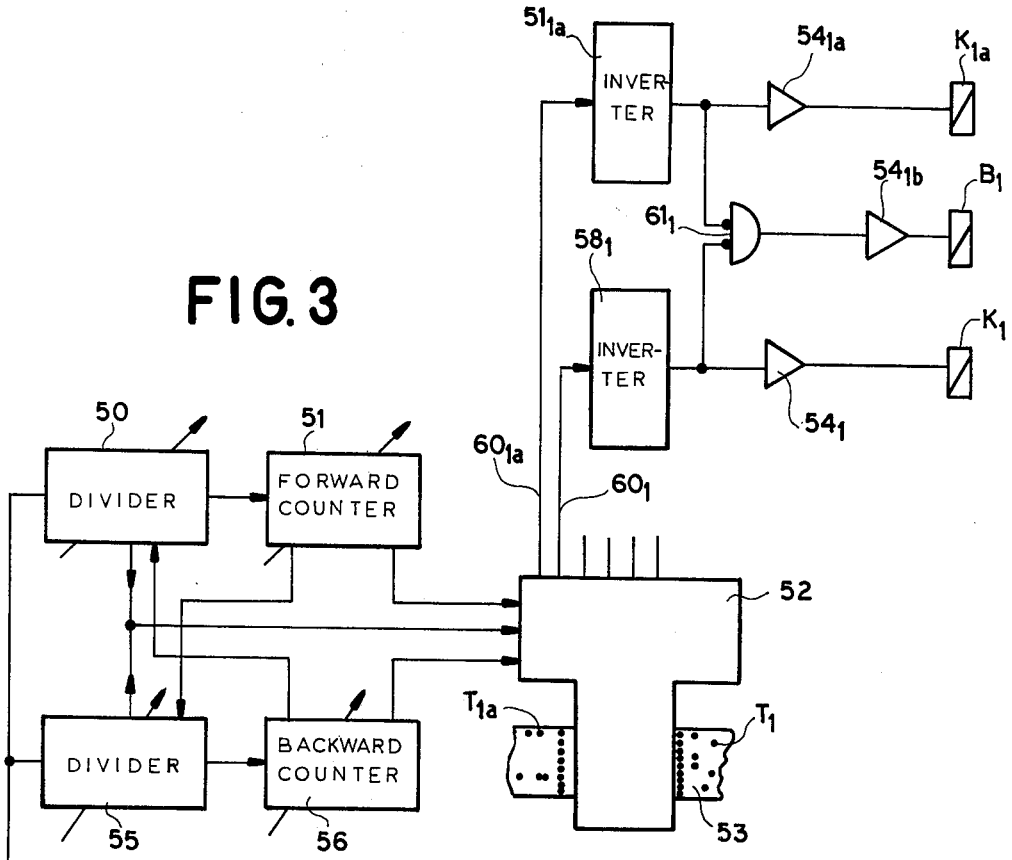
FIG. 3 is another largely schematic view illustrating another detail of the system according to this invention.

FIG. 3 shows further details of the drive $D_1$. This arrangement is provided with a pair of settable dividers 50 and 55 connected to the detector 6 and having outputs connected to respective counters 51 and 56 and to a reader 52 for a perforated band 53. This band 53 is of the type having eight information tracks and a transport track, information tracks $T_1$ and $T_{1a}$ for the clutches $K_1$ and $K_{1a}$ being illustrated. The counter 51 is a so-called forward counter and can be set at any number between 0 and 999 and the counter 56 is a so-called backward counter and can similarly be set for any number between 0 and 999. The reader 52 is set up so that each time it receives a pulse from the forward counter 51 it advances the closed tape loop 53 one step in the forward direction, but each time it receives a pulse from the backward counter 56 it moves the tape loop 53 one step in the backward direction. The counters 51 and 56 are set up so that each time one of them arrives at the count it is set for it delivers a signal to the other counter and resets itself, so that thereafter the other divider and counter will take over until it reaches the set count, whereupon it will switch back to the other divider and reset itself.

In addition the reader 52 has an output for each of the clutches $K_1$–$K_{3a}$, the outputs $60_1$ and $60_{1a}$ being illustrated here. These outputs $60_1$ and $60_{1a}$ are connected through respective inverters $58_1$ and $58_{1a}$ to respective operational amplifiers $54_1$ and $54_{1a}$ in turn connected to the respective clutches $K_1$ and $K_{1a}$. The inverters $58_1$ and $58_{1a}$ can be set up so that the respective clutches $K_1$ or $K_{1a}$ either are closed when a punched hole is read in the band 53, or in the absence of such a hole. Thus in the event that one of the clutches must be closed most of the time, it is convenient to switch in the respective inverter so that the respective track of the tape need only be punched when the respective clutch is to be opened. Furthermore a NOR gate $61_1$ is connected to the output of both of the inverters $58_1$ and $58_{1a}$ and has an output in turn connected through a respective operational amplifier $54_{1b}$ to the brake $B_1$ of the drive $D_1$. In the event that neither of the clutches $K_1$ or $K_{1a}$ of the drive $D_1$ is closed, the brake $B_1$ is therefore closed.

This arrangement as shown in FIG. 3 operates therefore as follows:

The forward counter 51 is set, for example, at 997 so that the tape loop 53 will move in the forward direction through the reader 52 through 997 steps, until the set number is reached on the forward counter. Each such step corresponds to a predetermined angular displacement of the spindle $SP_d$ as determined by the setting on the divider 50. Now assuming that the backward counter reaches 997 it will reset itself to 0 and switch in the backward counter 56 until this element counts to 989 with simultaneous backward displacement of the tape loop 53 through 989 steps. Then, of course, the cycle is reversed. Thus the forward displacement will start again in a position offset by eight steps to backward displacement. In this manner it is possible to obtain a certain patterning without having to use a random-signal generator, greatly simplifying the operation of the machine. Of course it is possible to set the forward and backward counters 51 and 56 at the same numbers to exactly reproduce the same pattern on two separate machines.

As mentioned above, the tape 53 has eight information tracks of which only six are employed to operate the clutches $K_1$–$K_{3a}$. It is possible to use the remaining two tracks to repeat particular pattern sections. If, for example, it is desired in a particular section of the tracks $T_1$ and $T_{1a}$ to create a particular pattern, for example a so-called flame, during backward displacement of the tape over the length of this section, a mirror-symmetrical repetition of this flame can be obtained on the respective strand. This mirror-image repetition of the flame then is repeated on the original flame when the tape is again run through in the forward direction.

The invention, therefore, allows for various patterns to be set up on the tape and the feed rates of the various strands to be controlled individually, and even set during the operation of the machine. What is more a random-signal can be avoided, while nonetheless obtaining a nonrepetitious and extremely attractive pattern. The particular effects can be made relatively shorter or relatively long by setting the dividers 50 and 55 so that the device according to this invention can very easily be set up to obtain the most varied possible effect. Even the overall feed rate can be increased or decreased without changing the proportionality of the various effects, so that the system according to the invention can be adjusted to pull the yarns off various bobbins at the speeds which are most practical for the respective feed devices.

Figure 4:
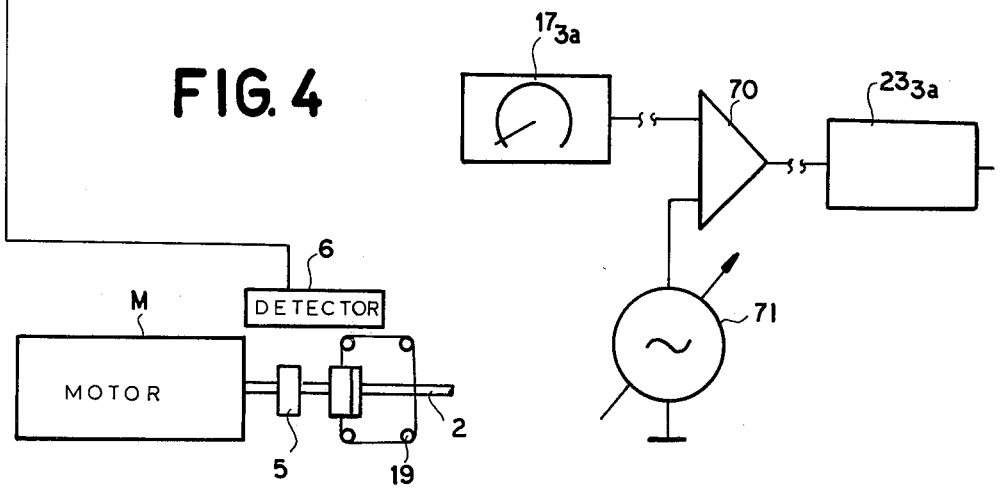
FIG. 4 is an arrangement illustrating an alternative arrangement for the system of this invention.

As seen in FIG. 4 it is possible to provide between any of the input devices such as $17_{3a}$ and the respective converter $23_{3a}$ an operational amplifier 70 fed from a source 71 with an alternating-current signal that can be varied within a wide range. Thus it is possible to periodically vary the effect of a particular single strand even within a given pattern. The arrangement according to the instant invention therefore allows a multi-ply effect yarn to be produced with virtually any conceivable effect. Once programmed the machine will automatically produce the desired yarn and particular aspects of the yarn can even be changed as it is being twisted. Such a machine can readily be set up for experimental use.

We claim:

1. A system for making a multi-ply yarn, said system comprising:

a yarn-winding body;

a pair of separate feed means each including a strand-feed element for engaging and advancing a respective strand to said body, and a pair of separate variable-speed electric motors operable at different motor speeds and alternately connectable to the respective element for driving same at a respective feed speed related directly to the respective motor speed;

control means for electrically varying said motor speed of said motors independently of one another and for alternately connecting the motors of each feed means to the respective feed element for feeding each of said strand to said body at either of the two respective feed speeds; and means for winding up said strands on said body to form a multiply yarn.

2. The system defined in claim 1 wherein each of said drive means includes for each of said motors a respective clutch connecting the respective motor to the respective strand-feed element, said clutches being connected to and operable by said control means.

3. The system defined in claim 2 wherein each of said drive means includes a brake for arresting the respective strand-feed element and operable by said control means.

4. The system defined in claim 3 wherein each of said feed means includes means for energizing the respective brake and arresting the respective strand-feed element in a condition with both of the respective clutches open and both of the respective motors disconnected from the respective strand-feed element.

5. The system defined in claim 1 wherein each of said motors is of the induction type and operates at a motor speed directly related to the frequency of its feed voltage, and each of said feed means includes a variable-frequency reference-voltage generating means.

6. The system defined in claim 5 wherein each of said generating means includes a variable-voltage reference-voltage generator and a voltage/frequency converter connected between the respective generator and the respective motor.

7. The system defined in claim 5, further comprising means for generating a voltage generally proportional to the rotation rate of said yarn-winding body.

8. The system defined in claim 7 wherein said means for generating is connected to all of said voltage/frequency converters for operating said motors at respective motor rates determined both by the respective generators and by said means for generating, whereby each of said elements will rotate at a rate which will vary directly with and form a fixed ratio with the rotation of said yarn-winding body.

9. The system defined in claim 8, further comprising means for preventing rotation of said yarn-winding body when respective predetermined maximum rotation rates for any yarn strand-feed elements is exceeded.

10. The system defined in 1, further comprising means operatively connected to said yarn-winding body and to said strand-feed elements for calculating and displaying the feed rate for any of said strands.

11. The system defined in claim 1, further comprising:

a longitudinally elongated data carrier having for each of said motors a respective instruction track carrying a succession of instructions for the respective motor;

means for reading said tracks longitudinally forwardly and backwardly and for applying the instructions to the respective motors;

means for generating a series of pulses having a frequency directly proportional to the rotation rate of said yarn-winding body;

settable forward-counter means connected to said means for generating for reading said tracks forwardly through a presettable number of steps in synchronism with said frequency;

settable backward-counter means connected to said means for generating for reading said tracks backwardly through a presettable number of steps in synchronism with said frequency;

means including connections between said counter means for alternating there between and for resetting same when each reaches the respective number.

12. The system defined in claim 11 wherein said data carrier is a tape loop.

13. The system defined in claim 12 wherein said tape loop is perforated, said perforations constituting said instructions.

14. The system defined in claim 1, further comprising means for periodically and regularly varying at least one of said motor speeds.

* * * * *